US005090507A

United States Patent [19]

Olson et al.

[11] Patent Number: 5,090,507

[45] Date of Patent: Feb. 25, 1992

[54] LOAD LIMITING APPARATUS FOR A HOIST

[75] Inventors: Wayne L. Olson, Central Point; Gary E. Choate, Lakewood, both of Oreg.

[73] Assignee: Rose Manufacturing Company, Englewood, Colo.

[21] Appl. No.: 605,240

[22] Filed: Oct. 29, 1990

[51] Int. Cl.[5] ..... A62B 1/10

[52] U.S. Cl. ..... 182/234; 182/3; 254/346

[58] Field of Search ..... 182/234, 239, 235, 3; 254/364, 365, 369, 348, 346, 372

[56] References Cited

U.S. PATENT DOCUMENTS 2,990,131 6/1961 Carlsson ..... 182/239 X
4,304,372 12/1981 Smith ..... 254/346 X
4,489,919 12/1984 Ostrobrod ..... 254/346
4,511,123 4/1985 Ostrobrod ..... 182/234 X
4,589,523 5/1986 Olson et al. .
4,602,699 7/1986 Matt ..... 182/234
4,603,759 8/1986 Hamada ..... 182/234
4,623,038 11/1986 Stancato ..... 182/239

*Primary Examiner*—J. Franklin Foss
*Attorney, Agent, or Firm*—Klaas & Law

[57] ABSTRACT

Apparatus for limiting the amount of force applied to a cable of a hoist by applying a force on clutch plates which are operatively joined to rotatable plates so that there is relative rotation between the clutch plates and the rotatable place when a force, equivalent to that placed on the clutch plates, is placed on the load supporting end of the cable. Also, two fall arresting devices are provided.

20 Claims, 5 Drawing Sheets

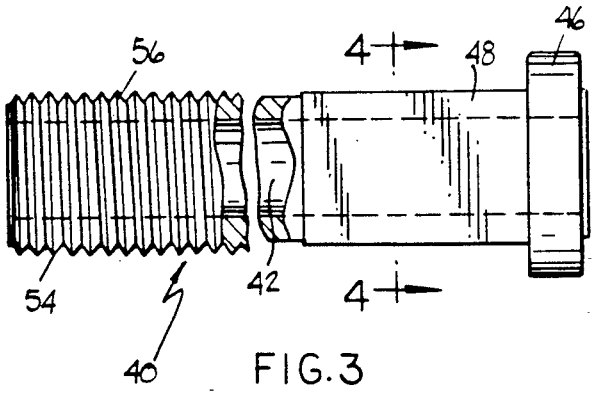
FIG.3
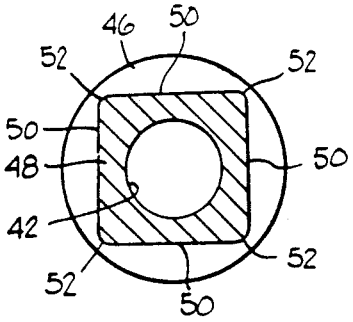
FIG.4
FIG.6
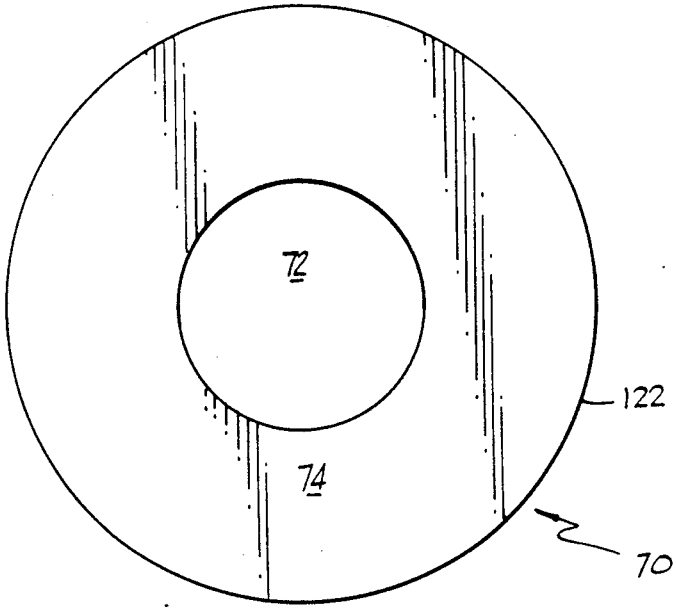
FIG.5
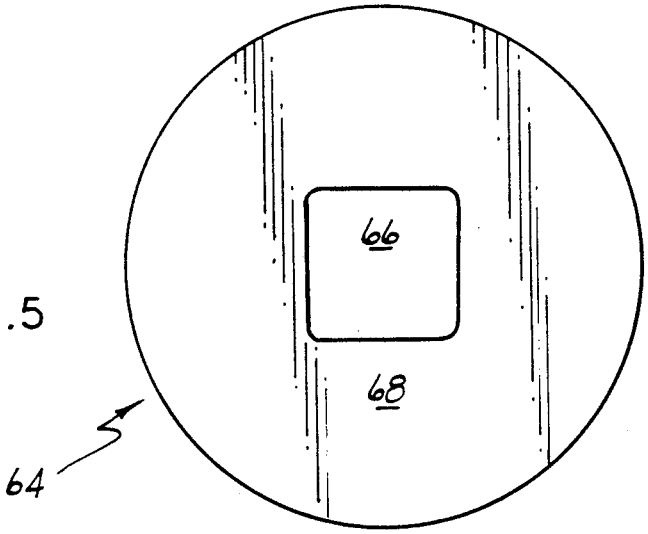

LOAD LIMITING APPARATUS FOR A HOIST

FIELD OF THE INVENTION

The invention relates generally to apparatus for raising, lowering or positioning personnel or materials using a hoist and more particularly to apparatus for placing a load limit on the cable of the hoist.

BACKGROUND OF THE INVENTION

Various types of apparatus are in use for lowering, raising and positioning personnel or materials at locations which are not readily accessible. Also, many times the personnel or materials are not visible to the operator of the apparatus for the raising, lowering and positioning of the personnel or materials. Therefore, it is desirable to limit the amount of force placed on personnel in the event that they encounter an obstacle when they are being raised. Also, it is desirable to limit the load that can be placed on the cable to prevent injury to the operator. Another desirable feature for the apparatus of this type is to provide for arresting the fall of personnel in the event that there is a failure in the portion of the apparatus applying a force on the cable of the apparatus.

BRIEF DESCRIPTION OF THE INVENTION

This invention provides apparatus for limiting the load that can be placed on line means, such as a cable, of a hoist and for arresting the fall of personnel attached to such line means.

In a preferred embodiment of the invention, the apparatus for limiting the amount of force that can be placed on the line means of a hoist comprises a housing that is mounted at a fixed location which housing has a fixed axle on which a drum having line means, such as a cable, wound thereon is rotatably mounted. The mounting means for rotatably mounting the drum on the axle include clutch means for rotation with the drum and for applying a force to rotate the drum. Rotatable means are operatively connected to the clutch means to rotate the clutch means. Drive means are provided for rotating the rotatable means. Force applying means are provided for applying a force on the clutch means and rotatable means to provide for relative rotation between the clutch means and the rotatable means when a force, substantially equivalent to the force applied by the force applying means, is placed on a load supporting device connected to the line means.

In a preferred embodiment of the invention, the mounting means comprise a hollow rotatable axle that is mounted on the fixed axle for rotation relative thereto. The hollow rotatable axle has an enlarged head portion, a middle portion having a generally rectangularly shaped transverse cross-sectional configuration having four rounded corners and an end portion having at least one threaded portion. A first pressure plate is mounted on the rotatable axle. The pressure plate has an opening formed therein which opening has a generally rectangularly shaped cross-sectional configuration for permitting axial movement thereof over the middle portion and into contacting relationship with the enlarged head portion to limit the axial movement of the first pressure plate and for rotation with the middle portion. A first clutch plate has an opening formed therein, which opening has a generally rectangularly shaped transverse cross-sectional configuration. The first clutch plate is mounted on the middle portion for rotation therewith and for permitting axial movement of the first clutch plate over the rotatable axle. The first clutch plate is in contacting relationship with the first pressure plate. A first rotatable plate has an opening formed therein, which opening has a transverse cross-sectional configuration that is larger than the transverse cross-sectional configuration of the middle portion to permit rotation of the first rotatable plate relative to the middle portion. The first rotatable plate is in contacting relationship with the first clutch plate. A second clutch plate has an opening formed therein, which opening has a generally rectangularly shaped cross-sectional configuration. The second clutch plate is mounted on the middle portion for rotation therewith and for permitting axial movement of the second clutch plate over the rotatable axle. The second clutch plate is in contacting relationship with the first rotatable plate. A second rotatable plate has an opening formed therein, which opening has a transverse cross-sectional configuration that is larger than the transverse cross-sectional configuration of the middle portion to permit rotation of the second rotatable plate relative to the middle portion. The second rotatable plate is in contacting relationship with the second clutch plate. An annular member, comprising a portion of the drive means, extends radially inwardly therefrom. The annular member has an opening formed therein, which opening has a transverse cross-sectional configuration that is circular and has a diameter that is slightly larger than the diameter between opposite rounded corners of the middle portion to permit rotation of the annular member relative to the middle portion and to function as a centering member. The annular member is in contacting relationship with the second rotatable plate. A third rotatable plate has an opening formed therein, which opening has a transverse cross-sectional configuration that is larger than the transverse cross-sectional configuration of the middle portion to permit rotation of the first rotatable plate relative to the middle portion. The third rotatable plate is in contacting relationship with the annular member. A third clutch plate has an opening formed therein, which opening has a generally rectangularly shaped cross-sectional configuration. The third clutch plate is mounted on the middle portion for rotation therewith and for permitting axial movement of the third clutch plate over the rotatable axle. The third clutch plate is in contacting relationship with the third rotatable plate. A fourth rotatable plate has an opening formed therein, which opening has a transverse cross-sectional configuration that is larger than the transverse cross-sectional configuration of the middle portion to permit rotation of the fourth rotatable plate relative to the middle portion. The fourth rotatable plate is in contacting relationship with the third clutch plate. A fourth clutch plate has an opening formed therein, which opening has a generally rectangularly shaped cross-sectional configuration. The fourth clutch plate is mounted on the middle portion for rotation therewith and for permitting axial movement of the fourth clutch plate over the rotatable axle. The fourth clutch plate is in contacting relationship with the fourth rotatable plate. A second pressure plate is mounted on the rotatable axle and has an opening formed therein which opening has a generally rectangularly shaped cross-sectional configuration for permitting axial movement thereof over the middle portion and for rotation with the middle portion and is in contacting relationship with the fourth clutch plate. Securing means are provided for securing the first, second, third and fourth rotatable plates to the annular member for rotation therewith. Connecting means are provided for connecting at least a portion of one of the end walls to the second pressure plate for rotation therewith. The force applying means act on the portion of the one end wall to move the end wall into contacting relationship with the second pressure plate to apply the force on the fourth clutch plate, the fourth rotatable plate, the third clutch plate, the third rotatable plate, the annular member, the second rotatable plate, the second clutch plate, the first rotatable plate, the first clutch plate, the first pressure plate and the enlarged head portion to hold them in the contacting relationship.

A first fall arresting device is mounted on the housing and is of the type illustrated in U.S. Pat. No. 4,589,523 which is incorporated herein by reference thereto. If a worker falls, the movement of the line means is stopped by the fall arresting device. In addition, the relationship between the clutch plates and the rotatable plates will limit the amount of the load that can be placed on the worker. Once the load on the line means is less than the force applied by the force applying means, the fall of the worker will be stopped.

A second fall arresting apparatus is provided and comprises a force applying member that is threadedly mounted on the fixed axle and has a plurality of circumferentially spaced apart abutments formed thereon. A deformable washer is mounted for slidable movement on the fixed axle and is located between the force applying member and a portion of the housing surrounding the fixed axle. At least one pawl is pivotally mounted on one of the end walls of the drum so that the at least one pawl rotates with the drum. The pawl has an abutment end for engagement with one of the plurality of abutments. The pawl has a center of gravity located so that rotation of the drum at a sufficiently great velocity will pivot the pawl so that the abutment end will move into contact with one of the plurality of abutments to rotate the force applying member. The rotation of the force applying member moves the force applying member toward the portion of the housing surrounding the axle to deform the deformable washer until rotation of the drum is stopped.

A safety stop is provided near the end of the line means on the drum. The line means are wound on the center portion of the drum so that portions of the line means form a plurality of rows on the center portion of the drum. Deformable means join together two adjacent turns of the line means forming the first row of the drum next adjacent to the center portion. The deformable means will hold the two adjacent turns together to a limit when the deformable means break.

BRIEF DESCRIPTION OF THE DRAWINGS

Illustrative and presently preferred embodiments of the invention are shown in the accompanying drawings in which:

FIG. 3 is an elevational view of the rotatable axle;

FIG. 4 is a cross-sectional view taken on the line 4-4 of FIG. 3;

FIG. 5 is an elevational view of a clutch plate;

FIG. 6 is an elevational view of a rotatable plate;

DETAILED DESCRIPTION OF THE INVENTION

Figure 1:
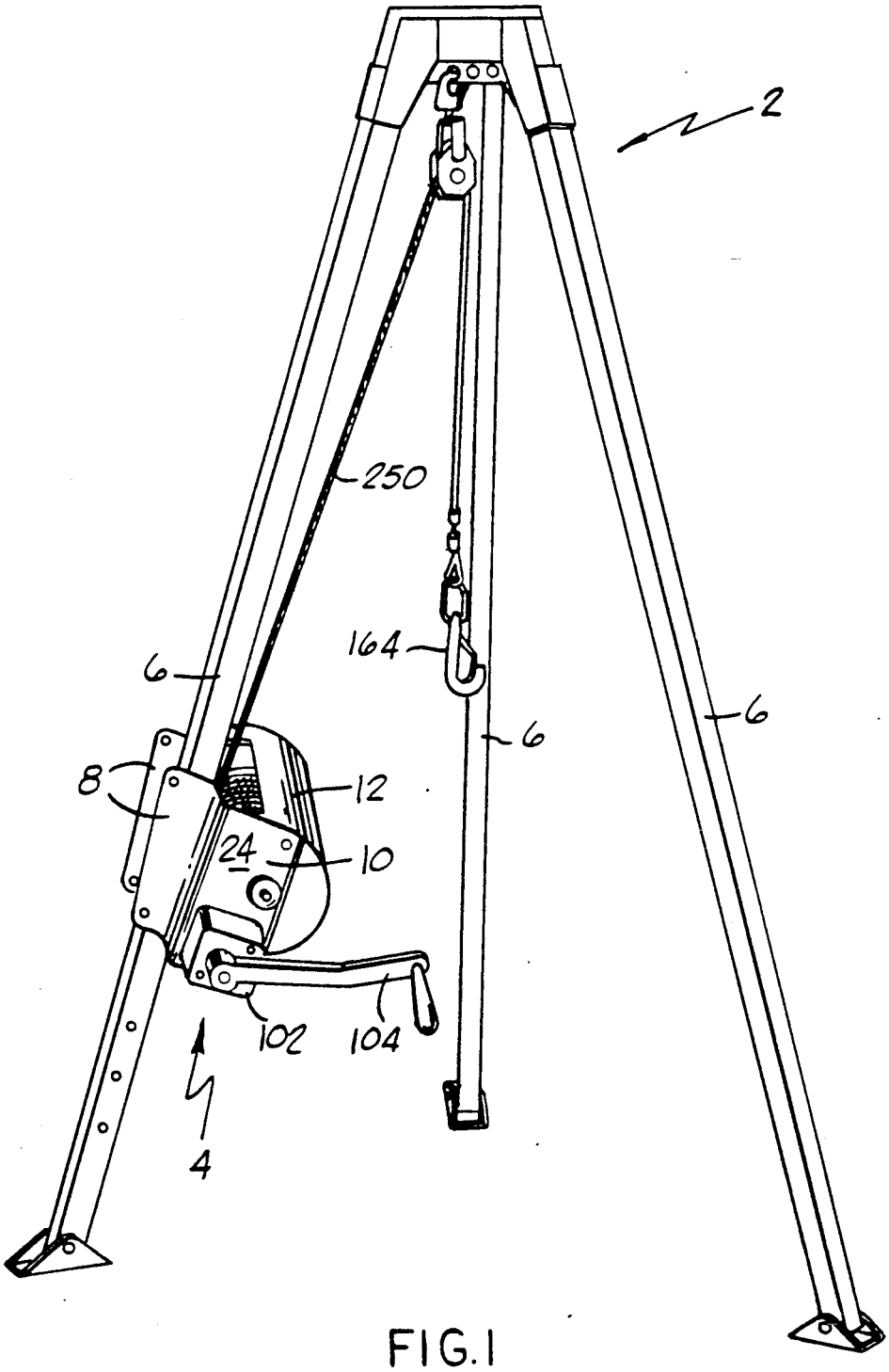
FIG. 1 is a perspective view of a conventional tripod anchorage with a hoist of this invention mounted thereon.

In FIG. 1, there is illustrated a conventional tripod anchorage 2 such as that marketed by Rose Manufacturing company under the trade designation "ROPOD". The apparatus 4 of this invention is mounted on one of the legs 6 of the tripod anchorage 2 using flange portions 8 of the housing 10. A cover 12 is secured on the housing 10.

In FIGS. 2-6, there is illustrated the mounting means for mounting the apparatus 4. The housing 10 comprises a base 20 and two opposite sidewalls 22 and 24 in addition to the flange portions 8. A fixed axle 26 having an enlarged head portion 28 passes through an opening 30 in the sidewall 22 and through an opening 32 in a support member 34 which is threaded into an opening 35 in the sidewall 24. A nut 36 is in threaded engagement with the threaded end portion 38 of the axle 26 and cooperates with the enlarged head portion to mount the fixed axle 26 securely on the sidewalls 22 and 24.

Figure 2:
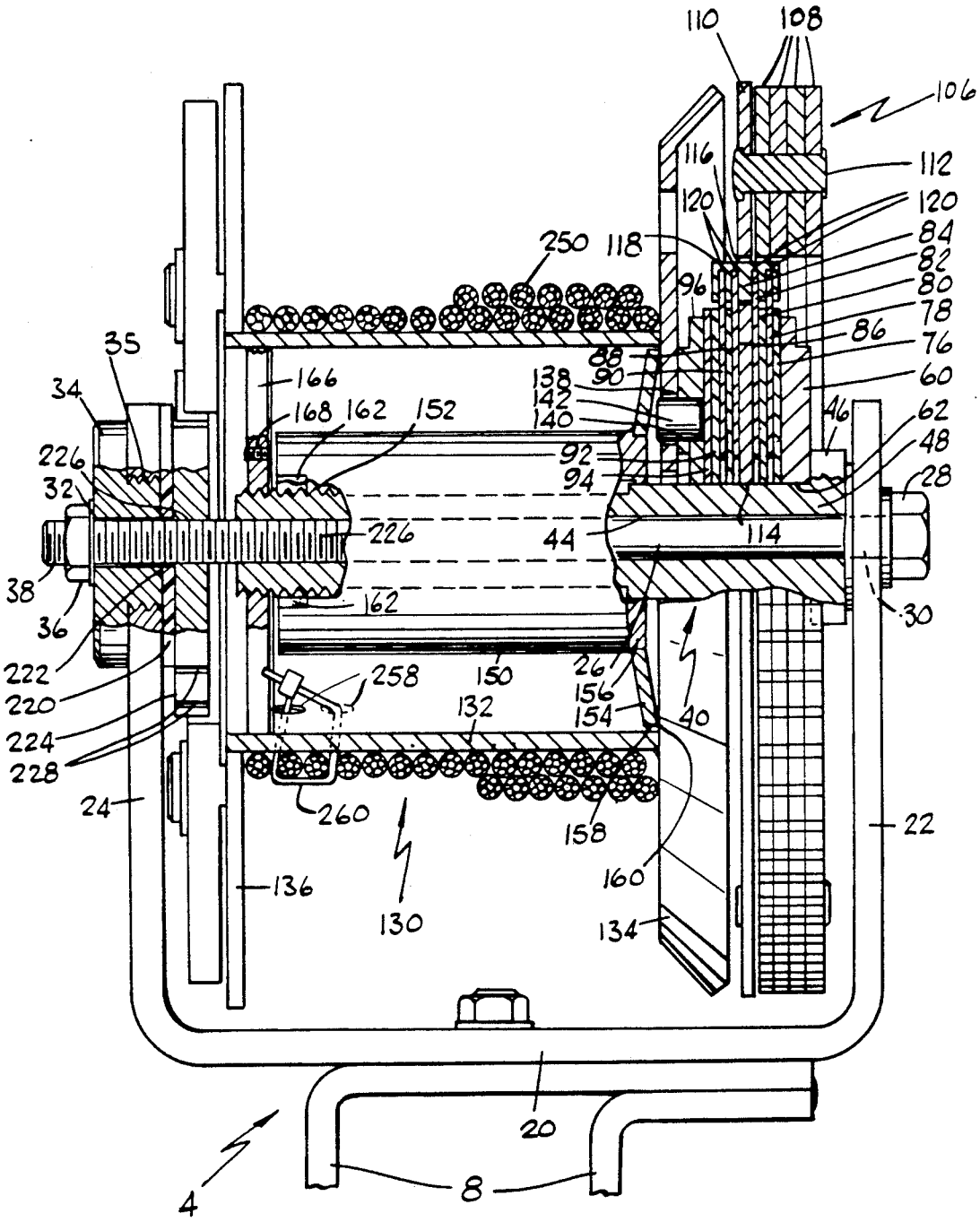
FIG. 2 is an elevational view with parts in section illustrating the invention.

A hollow rotatable axle 40, FIGS. 2-4, has a generally cylindrical inner surface 42 having a diameter slightly larger than the diameter of the generally cylindrical outer surface 44 of the fixed axle 26 so that the hollow rotatable axle 40 can rotate relative to the fixed axle 26. If desirable, a rotatable axle (not shown) can be located between the outer surface 44 and the inner surface 42. The rotatable axle 40 has an enlarged head portion 46, a middle portion 48 having four linearly extending sides 50 connected by rounded corners 52 to provide the middle portion 48 with a generally rectangularly shaped transverse cross-sectional configuration, preferably a square, having rounded corners and an end portion 54 having external threads 56.

A first pressure plate 60 has an opening 62 having a generally rectangularly shaped transverse cross-sectional configuration, preferably a square, to mate and rotate with the middle portion 48. The first pressure plate 60 is moved over the middle portion 48 and abuts against the enlarged head portion 46. In FIG. 5, there is illustrated a clutch plate having opening 66 having a generally rectangularly shaped transverse cross-sectional configuration to mate and rotate with the middle portion 48. The clutch plate 64 has oppositely facing generally planar surfaces 68. The clutch plates referred to below are shaped similarly to the clutch plate 64 and are formed from a metallic material such as stainless steel.

In FIG. 6, there is illustrated a rotatable plate 70 having a circular opening 72 having a diameter that is greater than the diameter between opposite rounded corners 52 of the middle portion 48 so that the rotatable plate 70 can rotate relative to the middle portion 48. The rotatable plate 70 has oppositely facing generally planar surfaces 74. The rotatable plates referred to below are shaped similarly to the rotatable plate 70 and are formed from a metallic material, such as brass. In FIG. 2, there is illustrated a first clutch plate 76 in contacting relationship with the first pressure plate 60; a first rotatable plate 78 in contacting relationship with the first clutch plate 76; a second clutch plate 80 in contacting relationship with the first rotatable plate 78; a second rotatable plate 82 in contacting relationship with the second clutch plate 80; and annular member 84, described more fully below, in contacting relationship with the second rotatable plate 82; a third rotatable plate 86 in contacting relationship with the annular member 84; a third clutch plate 88 in contacting relationship with the third rotatable plate 86; a fourth rotatable plate 90 in contacting relationship with the third clutch plate 88; a fourth clutch plate 92 in contacting relationship with the fourth rotatable plate 90; a fifth clutch plate 94 in contacting relationship with the fourth clutch plate 92 and a second pressure plate 96, shaped similarly to the first pressure plate 60, in contacting relationship with the fifth clutch plate 94.

The drive means for the apparatus 4 is illustrated in FIGS. 1 and 2. A fall preventing device 102 of the type illustrated in U.S. Pat. No. 4,589,523 has rotatable gear means which are rotated by the crank arm 104 and which are engaged with a gear 106 (FIG. 2) which is formed by a lamination of annular plates 108 and the outer portion 110 of the annular member 84 and held together by a plurality of rivets 112. The annular member 84 has a central opening 114 having a generally cylindrical inner surface that has a diameter slightly greater than the diameter of opposite rounded corners 52 of the middle portion 48 so that the annular member 84 may rotate relative to the middle portion 48. The annular member 84 has a plurality of off center openings 116 formed therein. A pin 118 passes through each of the openings 116 and through a plurality of slots 120 formed in the outer rim portions of the first, second third and fourth rotatable plates 78, 82, 86 and 90 so that they will rotate with the annular member 84 and will be properly located relative to the first through fifth clutch plates 76, 80, 88, 92 and 94 and the first and second pressure plates 60 and 96.

In FIG. 2, there is illustrated a drum 130 having a center section 132 and two end walls 134 and 136 secured to the center section 132 by suitable means such as by welding. The end wall 134 has a plurality of openings 138 which are aligned with similar openings 140 in the second pressure plate 96. A pin 142 is located in the openings 138 and 140 so that the end wall 134 is mounted on the second pressure plate 96 for rotation therewith.

Force applying means are provided and comprise a sleeve member 150 having an internally threaded portion 152 for threaded engagement with the external threads 56 of the rotatable axle 40. A belleville washer 154 is seated in a recess 156 in the sleeve member 150 and the rim portion 158 of the belleville washer bears against a portion 160 of the end wall 134. The sleeve member 150 has flat portions 162 so that a tool may be placed thereon to tighten the sleeve member 150 on the external threads 56. As the sleeve member 150 is tightened onto the external threads 56, it applies a force on the end wall 134 which is transmitted to the first and second pressure plates 60 and 96, the first through the fifth clutch plates 76, 80, 88, 92 and 94, the first through the fourth rotatable plates 78, 82, 86 and 90 and the annular member 84 so that they are clamped together between the enlarged head portion 46 and the belleville washer 154. The amount of force applied by the sleeve member 150 can be varied as desired. In a preferred embodiment of the invention, the sleeve member 150 is tightened so that the rotatable plates 78, 82, 86 and 90 and the clutch plates 76, 80, 88, 92 and 94 rotate together until an equivalent force of 600 pounds is placed on the swivel snaphook 164. Therefore, if a force greater than 600 pounds is placed on the swivel snaphook 164, there will be relative rotation between the rotatable plates 78, 82, 86 and 90 and the clutch plates 76, 80, 88, 92 and 94. If personnel were being lifted by the apparatus 4 and an obstacle blocked their upward movement, the maximum force applied to the personnel would be limited to 600 pounds. If a worker falls, the maximum force placed on the worker would be 600 pounds and would be stopped if the load on the line means is less than 600 pounds. Also, if materials were placed on a platform attached to the swivel snaphook 164 and exceeded 600 pounds, the maximum force placed by an operator on the crank arm 104 would be the 600 pounds so that the platform would not be lifted. After the desired amount of force has been applied by the sleeve member 150, a spanner nut 166 is threaded onto the external threads 56 and moved into contact with the sleeve member 150. A set screw 168 is then tightened to urge the sleeve member 150 and the spanner nut 166 apart to lock them in position on the external threads 56.

Figure 7:
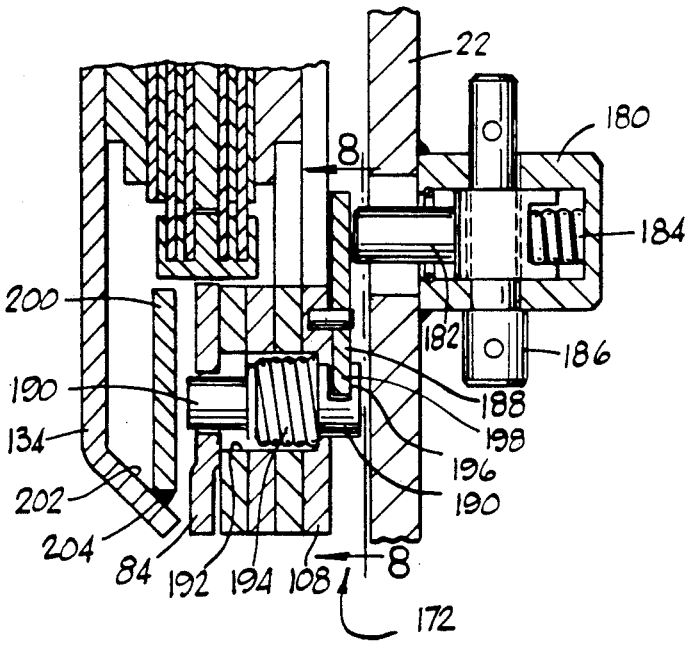
FIG. 7 is an elevational view of emergency apparatus for use with this invention.
Figure 8:
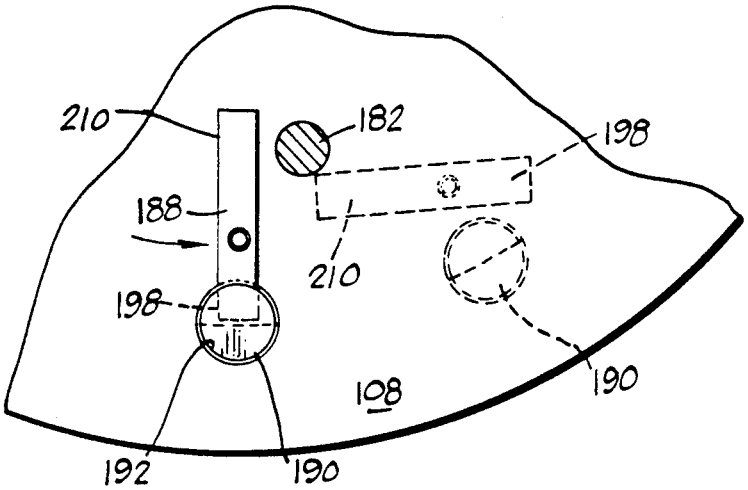
FIG. 8 is a cross-sectional view taken on the line 8—8 of FIG. 7.
Figure 9:
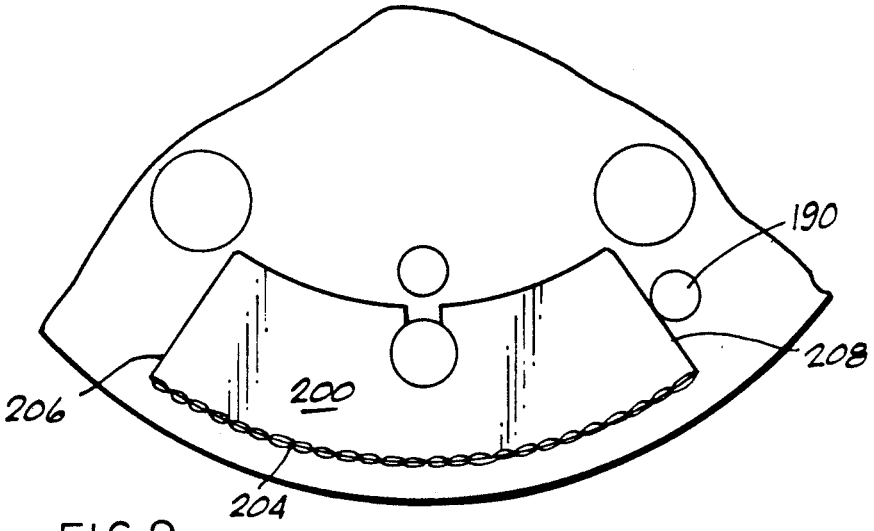
FIG. 9 is an elevational view of a portion of FIG. 8.

In the event of an emergency where it is desired to be able to lift additional weights exceeding the force put on the apparatus 4, emergency apparatus 172 is provided and is illustrated in FIGS. 7–9. A housing 180 is mounted on the sidewall 22. A pin 182 is mounted for sliding movement in the housing 180 and resilient means 184 urge the pin 182 in a direction toward the end wall 134. A stop pin 186 prevents movement of the pin 182. In FIGS. 7 and 8, there is illustrated a lever arm 188 that is pivotally mounted on the outer plate 108 of the gear 106. A pin 190 is mounted for sliding movement through aligned openings 192 in the plates 108 and the annular member 84. Resilient means 194 urge the pin 190 in a direction of the end wall 134. A slot 196 is formed in the pin 190 and a portion 198 of the lever arm 188 is located in the slot 196 to prevent movement of pin 190. In FIGS. 7 and 9, there is illustrated a stop plate 200 that is secured to the surface 202 of the end wall 134 by suitable means, such as by welding 204. The stop plate 200 has opposite end portions 206 and 208 which are located to be contacted by the pin 190. When an emergency situation arises, the stop pin 186 is pulled out. This permits pin 182 to move partially out of the housing 180. As the gear 106 rotates, the end portion 210 of the lever arm 188 contacts the pin 180 and is rotated thereby to move the portion 198 out of the slot 196 to permit movement of the pin 190. The continued rotation of the gear 106 moves the pin 190 against one of the end portions 206 or 208 so that the crank arm 104 can be used to lift or lower any emergency loads.

Figure 10:
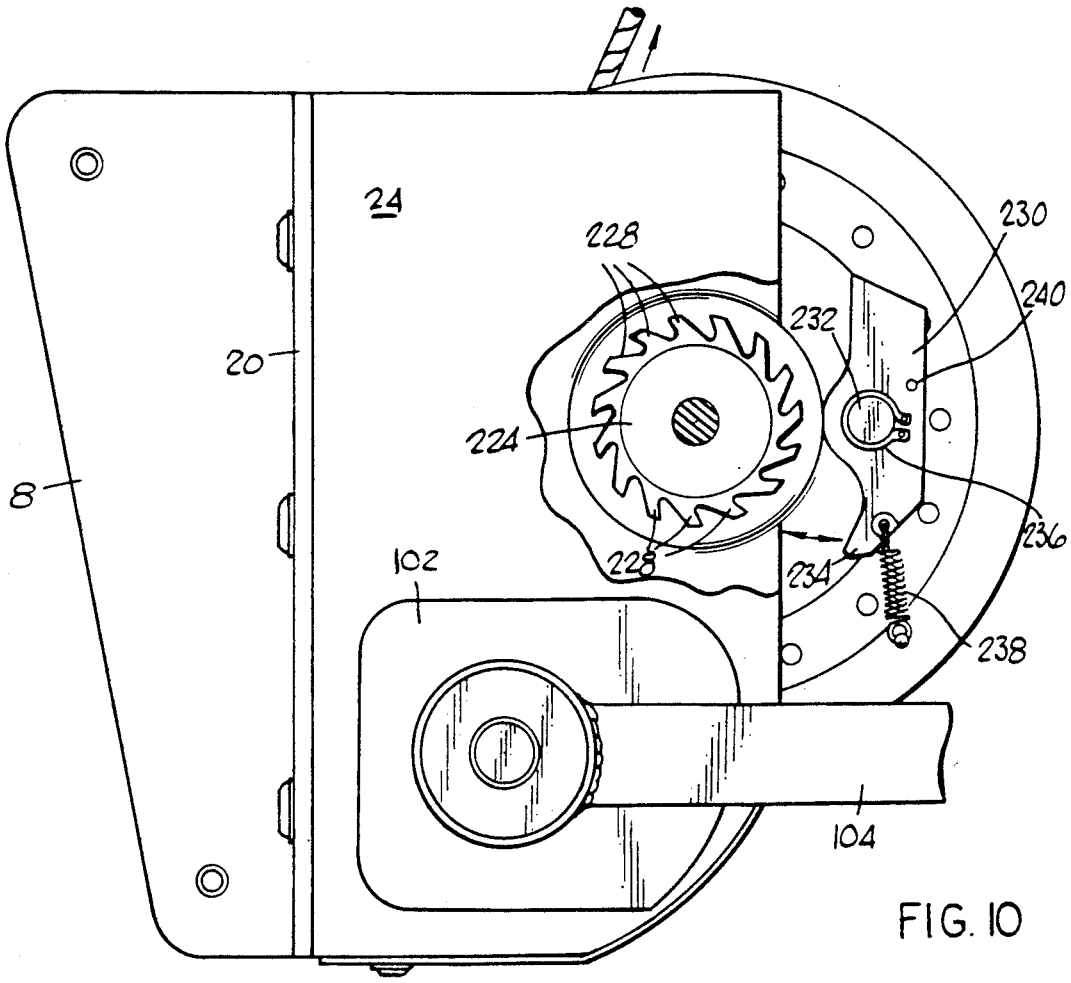
FIG. 10 is a side elevational view with parts removed of the fall arresting apparatus.
Figure 11:
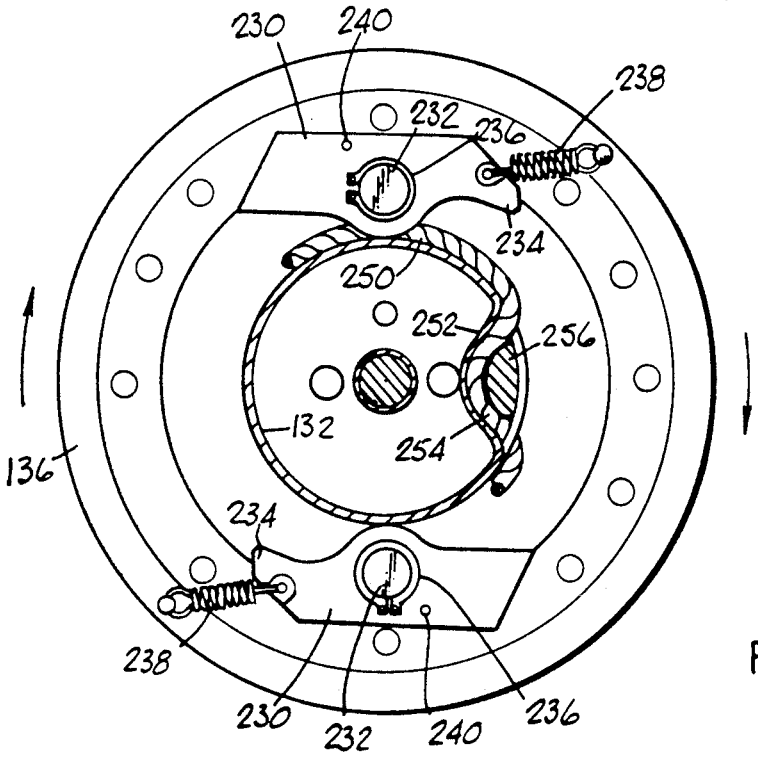
FIG. 11 is a side elevational view showing the attachment of the cable to the drum.

Fall arresting apparatus is illustrated in FIGS. 2, 10 and 11. A plastic washer 220 has a central opening 222 so that it can be positioned on the fixed axle 26. The plastic washer 220 is formed from a deformable plastic material, such as polyethylene. A force applying member 224 has an internally threaded portion 226 that is in engagement with the threaded portion 35. The force applying member 224 has a plurality of circumferentially spaced apart abutments 228 formed thereon. The plastic washer 220 is located between a portion of the sidewall 24 and the force applying member 224. A pair of pawls 230 are pivotally mounted on studs 232 projecting outwardly from the end wall 136. The pawls 230 have abutment end portions 234 adapted to be moved into contact with the abutments 228. Retaining means 236 are used to retain the pawls 230 on the studs 232. Resilient means 238 are used to position the pawls 230 at desired locations. The center of gravity 240 of each pawl 230 is located so that an initial rapid acceleration of the end wall 136 will apply an inertial force on the pawl 230 to urge the abutment end portions 234 in a direction away from the abutments 228. After the initial rapid acceleration has abated, the continued rotation of the end wall 136 will produce a force moving the abutment end portions into contact with the abutments 222. This will apply a force on the force applying member 224 to rotate it on the threaded end portion 38 so that it moves toward the sidewall 24 to deform the plastic washer 220. This will produce a braking effect on the end wall 136 to stop the rotation of the end wall 136.

A safety device is illustrated in FIGS. 1, 2 and 11. One end of the line means 250, such as a 3/16 inch galvanized steel wire rope, has a swivel snaphook 164 attached thereto while the other end thereof (not shown) is connected by conventional means to the end wall 134. The line means 250 are then wound around the center section 132. At a location after about three turns of the line means 250 on the center section 132, a pair of parallel cuts (not shown) are made in the center section 132 and a portion 252, FIG. 11, is pushed inwardly. A portion 254 of the line means 250 is pushed against the portion 252 and a metal rod 256 is passed through the space between the portion 252 and the portions of the center section 132 on each side of the portion 252. At a location at about the thirteenth and fourteenth turns of the line means 250 on the center section 132, a pair of spaced apart holes 258 are made in the center section 132. A strip 260 of plastic material, such as nylon, is passed around the thirteenth and fourteenth turns and through the holes 258. The ends of the plastic strip 260 are joined together by a weld 262. When the line means 250 had been unwound to the fourteenth turn, the plastic strip 260 would function to provide a warning that the end of the line means 250 is near. The strip 260 of plastic material will break at about 450 pounds. If the plastic strip 260 breaks, the final braking force is the metal rod 256.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. Apparatus for limiting the amount of force placed on line means of a hoist comprising:

a housing mounted at a fixed location;

a fixed axle mounted at a fixed location on said housing;

a drum having a center section and two end walls;

line means attached at a first end to said drum for being wound onto or unwound from said drum, said line means being attached at a second end to a load supporting device;

mounting means for mounting said drum for rotation on said fixed axle;

clutch means mounted on said mounting means for applying a force to rotate said drum;

rotatable means operatively connected to said clutch means for applying a limited force thereto to rotate said clutch means;

drive means for rotating said rotatable means; and force applying means for applying a force on said clutch means and said rotatable means to provide for rotation of said clutch means and said rotatable means together and to provide for relative rotation between said rotatable means and said clutch means when a force, equivalent to that produced by the force applying means, is applied to said load supporting device.

2. The invention as in claim 1 wherein said mounting means comprise:

a hollow rotatable axle mounted for rotation relative to said fixed axle;

said hollow rotatable axle having an enlarged head end, a middle portion having a generally rectangularly shaped transverse cross-sectional configuration with rounded corners and an end portion having at least one threaded portion;

at least one pressure plate having an opening therein, said opening having a rectangularly shaped transverse cross-sectional configuration to mate with said middle portion so that said at least one pressure plate may be positioned on said middle portion for rotation with said rotatable axle and for permitting axial movement of said at least one pressure plate over said rotatable bushing;

connecting means for connecting at least a portion of one of said end walls to said at least one pressure plate for rotation therewith;

stop means for limiting said axial movement of said at least one pressure plate; and said force applying means acting on said portion of said one of said end walls to move said portion into contact with said at least one pressure plate to apply said force on said clutch means and said rotatable means.

3. The invention as in claim 2 wherein said connecting means comprise:

said at least one pressure plate having at least one opening formed therein;

said portion of said one of said end walls having at least one opening formed therein; and a pin having portions thereof located in each of said openings.

4. The invention as in claim 2 wherein said clutch means comprise:

at least one clutch plate having an opening formed therein, said opening having a generally rectangularly shaped transverse cross-sectional configuration, said at least one clutch plate mounted on said middle portion for rotation therewith and for permitting axial movement of said at least one clutch plate over said middle portion.

5. The invention as in claim 4 wherein said rotatable means comprise:

at least one rotatable plate having an opening formed therein, said opening having a transverse cross-sectional configuration that is larger than said transverse cross-sectional configuration of said middle portion to permit rotation of said at least one rotatable plate relative to said middle portion.

6. The invention as in claim 5 and further comprising:

a plurality of clutch plates;

a plurality of rotatable plates; and said plurality of clutch plates and said plurality of rotatable plates assembled together in alternating relationship.

7. The invention as in claim 2 wherein said force applying means comprise:

force transmitting means for applying a force on said one of said end walls; and a force applying member threadedly mounted on said at least one threaded portion so that rotation of said force applying member moves said force applying member against said force transmitting means to apply said force on said one of said end walls.

8. The invention as in claim 7 wherein said force transmitting means comprises:

a belleville washer.

9. The invention as in claim 1 wherein said drive means comprise:

driven gear means connected to said rotatable means to rotate said rotatable means to rotate said clutch means and to rotate said drum until said equivalent force is applied to said load supporting device; and main drive means for rotating said driven gear means.

10. The invention as in claim 9 wherein said mounting means comprises:

a hollow rotatable axle mounted for rotation relative to said fixed axle;

said hollow rotatable axle having an enlarged head portion, a middle portion having a generally rectangularly shaped transverse cross-sectional configuration with rounded corners and an end portion having at least one threaded portion;

a first pressure plate mounted on said rotatable axle said first pressure plate having an opening formed therein, said opening having a generally rectangularly shaped cross-sectional configuration for permitting axial movement thereof over said middle portion and for rotation with said middle portion and in contacting relationship with said enlarged head portion to limit said axial movement of said first pressure plate;

a first clutch plate having an opening formed therein, said opening having a generally rectangularly shaped transverse cross-sectional configuration, said first clutch plate mounted on said middle portion for rotation therewith and for permitting axial movement of said first clutch plate over said middle portion;

said first clutch plate being in contacting relationship with said first pressure plate;

a first rotatable plate having an opening formed therein, said opening having a transverse cross-sectional configuration that is larger than said transverse cross-sectional configuration of said middle portion to permit rotation of said first rotatable plate relative to said middle portion;

said first rotatable plate being in contacting relationship with said first clutch plate;

an annular member comprising a portion of said driven gear means and extending radially inwardly therefrom;

said annular member having a circular opening formed therein, said circular opening having a diameter that is slightly larger than the diameter between opposite rounded corners of said middle portion to permit rotation of said annular member relative to said middle portion;

said annular member being in contacting relationship with said first rotatable plate;

a second rotatable plate having an opening formed therein, said opening having a transverse cross-sectional configuration that is larger than said transverse cross-sectional configuration of said middle portion to permit rotation of said second rotatable plate relative to said middle portion;

said second rotatable plate in contacting relationship with said annular member;

a second clutch plate having an opening formed therein, said opening having a generally rectangularly shaped cross-sectional configuration, said clutch plate mounted on said middle portion for rotation therewith and for permitting axial movement of said second clutch plate over said middle portion;

said second clutch plate being in contacting relationship with said second rotatable plate;

securing means for securing said first and second rotatable plates to said annular member for rotation therewith;

a second pressure plate mounted on said rotatable axle and having an opening formed therein, said opening having a generally rectangularly shaped cross-sectional configuration for permitting axial movement thereof over said middle portion and for rotation with said middle portion and being in contacting relationship with said second clutch plate;

connecting means for connecting at least a portion of one of said end walls to said second pressure plate for rotation therewith; and said force applying means acting on said portion of said one of said end walls to move said end wall into contacting relationship with said second pressure plate to apply said force on said second clutch plate, said second rotatable plate, said annular member, said first rotatable plate, said first clutch plate, said first pressure member and said enlarged head to hold them in said contacting relationship.

11. The invention as in claim 9 wherein said mounting means comprises:

a hollow rotatable axle mounted for rotation relative to said fixed axle;

said hollow rotatable axle having an enlarged head portion, a middle portion having a generally rectangularly shaped transverse cross-sectional configuration with rounded corners and an end portion having at least one threaded portion;

a first pressure plate mounted on said rotatable axle said pressure plate having an opening formed therein, said opening having a generally rectangularly shaped cross-sectional configuration for permitting axial movement thereof over said middle portion and for rotation with said middle portion and in contacting relationship with said enlarged head portion to limit said axial movement of said first pressure plate;

a first clutch plate having an opening formed therein, said opening having a generally rectangularly shaped transverse cross-sectional configuration, said first clutch plate mounted on said middle portion for rotation therewith and for permitting axial movement of said first clutch plate over said middle portion;

said first clutch plate being in contacting relationship with said first pressure plate;

a first rotatable plate having an opening formed therein, said opening having a transverse cross-sectional configuration that is larger than said transverse cross-sectional configuration of said middle portion to permit rotation of said first rotatable plate relative to said middle portion;

said first rotatable plate being in contacting relationship with said first clutch plate;

a second clutch plate having an opening formed therein, said opening having a generally rectangularly shaped cross-sectional configuration, said clutch plate mounted on said middle portion for rotation therewith and for permitting axial movement of said second clutch plate over said middle portion;

said second clutch plate being in contacting relationship with said first rotatable plate;

a second rotatable plate having an opening formed therein, said opening having a transverse cross-sectional configuration that is larger than said transverse cross-sectional configuration of said middle portion to permit rotation of said second rotatable plate relative to said middle portion;

said second rotatable plate in contacting relationship with said second clutch plate;

an annular member comprising a portion of said driven gear means and extending radially inwardly therefrom;

said annular member having a circular opening formed therein, said circular opening having a diameter that is larger than the diameter between opposite rounded corners of said middle portion to permit rotation of said annular member relative to said middle portion;

said annular member being in contacting relationship with said second rotatable plate;

a third rotatable plate having an opening formed therein, said opening having a transverse cross-sectional configuration that is larger than said transverse cross-sectional configuration of said middle portion to permit rotation of said first rotatable plate relative to said middle portion;

said third rotatable plate being in contacting relationship with said annular member;

a third clutch plate having an opening formed therein, said opening having a generally rectangularly shaped cross-sectional configuration, said clutch plate mounted on said middle portion for rotation therewith and for permitting axial movement of said third clutch plate over said middle portion;

said third clutch plate being in contacting relationship with said third rotatable plate;

rotatable plate having an opening formed therein, said opening having a transverse cross-sectional configuration that is larger than said transverse cross-sectional configuration of said middle portion to permit rotation of said fourth rotatable plate relative to said middle portion:

said fourth rotatable plate in contacting relationship with said third clutch plate;

a fourth clutch plate having an opening formed therein, said opening having a generally rectangularly shaped cross-sectional configuration, said clutch plate mounted on said middle portion for rotation therewith and for permitting axial movement of said fourth clutch plate over said middle portion;

said fourth clutch plate being in contacting relationship with said fourth rotatable plate;

a second pressure plate mounted on said rotatable axle and having an opening formed therein, said opening having a generally rectangularly shaped cross-sectional configuration for permitting axial movement thereof over said middle portion and for rotation with said middle portion and being in contacting relationship with said fourth clutch plate;

securing means for securing said first, second, third and fourth rotatable plates to said annular member for rotation therein;

connecting means for connecting at least a portion of one of said end walls to said second pressure plate for rotation therewith; and said force applying means acting on said portion of said one of said end walls to move said one of said end walls into contacting relationship with said second pressure plate to apply said force on said fourth clutch plate, said fourth rotatable plate, said third clutch plate, said third rotatable plate, said annular member, said second rotatable plate, said second clutch plate, said first rotatable plate, said first clutch plate, said first pressure plate and said enlarged head portion to hold them in said contacting relationship.

12. The invention as in claim 11 wherein said force applying means comprises:

force transmitting means for applying a resilient force on said one of said end walls; and a force applying member threadedly mounted on said at least one threaded portion so that rotation of said force applying member moves said force applying member against said force transmitting means to apply said force on said one of said end walls.

13. The invention as in claim 1 and further comprising:

emergency means for preventing said relative rotation between said rotatable means and said clutch means.

14. The invention as in claim 13 wherein said emergency means comprise:

coupling means for directly coupling said drum to said driven gear means so that rotation of said driven gear rotates said drum.

15. The invention as in claim 14 wherein said coupling means comprise:

a fixed stop member secured to one of said end walls;

a first pin extending through an axially extending opening in said driven gear and mounted therein for linear sliding movement;

first resilient means for urging said first pin toward a location for contacting said fixed stop member to couple said driven gear to said fixed stop member;

said first pin having a radially extending slot formed therein;

said driven gear having an outer surface portion;

a lever pivotally mounted on said outer surface portion;

a portion of said lever located in said radially extending slot to prevent movement of said first pin;

a small housing mounted on a portion of said housing;

a second pin mounted in said housing for linear sliding movement;

second resilient means for urging said second pin for movement toward said driven gear; and stop means mounted in said small housing to prevent movement of said second pin so that, when said stop means is removed, said second pin will move into a location to be contacted by said lever so that said lever will be pivoted out of said radially extending slot to permit movement of said first pin to a location to couple with said fixed stop member so that rotation of said driven gear rotates said drum.

16. Fall arresting apparatus comprising:

a housing mounted at a fixed location;

an axle mounted at a fixed location on said housing;

a drum mounted for rotation on said axle and having a center portion and two opposite end walls;

line means attached at a first end to said drum for being wound onto or unwound from said center portion of said drum, said line means being attached at a second end to a worker's safety harness;

a force applying member threadedly mounted on said fixed axle and having a plurality of circumferentially spaced apart abutments formed thereon;

a deformable washer mounted on said axle and located between said force applying member and a portion of said housing;

at least one pawl pivotally mounted on one of said end walls of said drum so that said at least one pawl rotates with said drum;

said pawl having an abutment end for engagement with one of said plurality of abutments;

said pawl having a center of gravity located so that rotation of said drum at a sufficiently great velocity will pivot said pawl so that said abutment end will move into contact with one of said plurality of abutments to rotate said force applying member; and said rotation of said force applying member moves said force applying member toward said housing to deform said deformable washer until rotation of said drum is stopped.

17. The invention as in claim 16 and further comprising:

resilient means for applying a force on said pawl to urge said abutment end in a direction away from said force applying member.

18. The invention as in claim 17 wherein:

said center of gravity is located so that an inertial force on said pawl caused by a sufficiently high acceleration of said drum will move said abutment end in a direction away from said force applying member.

19. Safety apparatus for noting the proximity of the end of the line means of a hoist comprising:

a housing mounted at a fixed location;

an axle mounted at a fixed location on said housing;

a drum mounted for rotation on said axle;

said drum having a center portion and two opposite end walls;

line means attached at a first end to said drum for being wound onto or unwound from said center portion of said drum, said line means being attached at a second end to a worker's safety harness;

said line means being wound on said center portion of said drum so that portions of said line means form a row on said center portion of said drum;

a plurality of rows of said line means on said center portion of said drum; and resilient means joining together two adjacent portions of the first row next adjacent to said center portion of said drum.

20. The invention as in claim 19 wherein said resilient means comprises:

a strip of plastic material extending around said two adjacent portions, passing through two spaced apart openings in said center portion and the ends thereof secured together.

* * * * *